US008657158B1

(12) United States Patent
Snell

(10) Patent No.: US 8,657,158 B1
(45) Date of Patent: Feb. 25, 2014

(54) SELECTABLE FLAVOR DISPENSER FOR A BEVERAGE CONTAINER

(76) Inventor: Jose L. Snell, Edinburg, TX (US)

( * ) Notice: Subject to any disclaimer, the term of this patent is extended or adjusted under 35 U.S.C. 154(b) by 162 days.

(21) Appl. No.: 13/196,501

(22) Filed: Aug. 2, 2011

Related U.S. Application Data

(60) Provisional application No. 61/369,824, filed on Aug. 2, 2010.

(51) Int. Cl.
*B67D 7/74* (2010.01)

(52) U.S. Cl.
USPC ..... 222/129; 206/219

(58) Field of Classification Search
USPC ..... 222/42, 132, 145.5, 205, 481.5, 485, 222/129, 94, 206–215; 206/219; 220/703, 220/705–710, 251–253; 215/6, 387, 388
See application file for complete search history.

(56) References Cited

U.S. PATENT DOCUMENTS

| | | | | | |
|---|---|---|---|---|---|
| 1,924,394 | A * | 8/1933 | Blank | 137/587 |
| 2,511,723 | A * | 6/1950 | Lewis | 215/16 |
| 2,787,296 | A | 4/1957 | O'Mailey | |
| 3,212,718 | A * | 10/1965 | Green | 239/394 |
| 3,217,931 | A | 11/1965 | Farrar et al. | |
| 3,723,851 | A | 3/1973 | Johnson et al. | |
| 3,739,955 | A * | 6/1973 | Gores | 222/385 |
| 3,917,119 | A * | 11/1975 | Kahn | 222/108 |
| 4,288,006 | A * | 9/1981 | Clover, Jr. | 222/42 |
| 4,971,226 | A * | 11/1990 | Donoghue | 222/207 |
| 5,031,799 | A | 7/1991 | Owen | |
| 5,431,276 | A * | 7/1995 | Lialin | 206/222 |
| 5,833,124 | A * | 11/1998 | Groves et al. | 222/158 |
| 6,024,012 | A | 2/2000 | Luzenberg, Jr. | |
| 6,269,979 | B1 | 8/2001 | Dumont | |
| 6,569,329 | B1 | 5/2003 | Nohren, Jr. | |
| 6,959,841 | B2 * | 11/2005 | Vlodek | 222/129 |
| 7,299,936 | B2 | 11/2007 | Singh et al. | |
| 8,074,825 | B1 * | 12/2011 | Ziegler | 220/523 |
| 8,104,642 | B2 * | 1/2012 | Bambrick et al. | 222/82 |
| 2007/0269251 | A1 * | 11/2007 | Skalitzky et al. | 401/2 |
| 2008/0093387 | A1 * | 4/2008 | Pivonka et al. | 222/205 |
| 2008/0290059 | A1 * | 11/2008 | Benbassat | 215/6 |
| 2011/0059208 | A1 * | 3/2011 | Benbassat | 426/115 |
| 2011/0204090 | A1 * | 8/2011 | Worthington et al. | 222/145.5 |

* cited by examiner

*Primary Examiner* — Lien Ngo
(74) *Attorney, Agent, or Firm* — Robert C. Montgomery; Montgomery Patent & Design

(57) ABSTRACT

A selectable flavor dispenser comprises a base beverage container, an additive selecting and dispensing assembly, and a drinking cup. The additive selecting and dispensing assembly each comprises an additive dispensing vial, a dispensing mechanism, and a dispensing actuator. By selecting and activating a specific actuator, a user is able to dispense a desired additive into a base beverage and deliver the mixture to the drinking cup through a straw, a check valve, and a bifurcated nozzle. A vacuum breaker allows incoming air to replace the volume of the depleted base beverage.

11 Claims, 4 Drawing Sheets

10

SELECTABLE FLAVOR DISPENSER FOR A BEVERAGE CONTAINER

RELATED APPLICATIONS

The present invention was first described in and claims the benefit of U.S. Provisional Application No. 61/369,824 filed on Aug. 2, 2010, the entire disclosures of which are incorporated herein by reference.

FIELD OF THE INVENTION

The present invention relates generally to a beverage container, and in particular, to a beverage container having an integral and selectively actuated flavor dispenser.

BACKGROUND OF THE INVENTION

Personal flavored beverages are one (1) of the most popular consumable items in the world. Such beverages include a variety of teas, juices, sodas, and many other popular beverages. Flavored beverages are also enjoyed by purchasing larger quantities in large containers or by utilizing flavor mixes which can be combined with water to produce a more flavorful beverage.

Such beverages are popular due to the fact that the wide range of brands and variety of flavors even within particular brands or types of beverage means that individuals can experience a wide range of flavors and will not necessarily become tired of experiencing a particular taste. However, even the smallest commonly available beverage containers provide a full serving's worth of liquid, while not affording the user any variety during the consumption of that liquid.

Various attempts have been made to provide beverage containers with a means for introducing a flavor additive into a beverage within the container. Examples of these attempts can be seen by reference to several U.S. patents. U.S. Pat. No. 4,785,931, issued in the name of Weir et al., describes a molded plastic closure providing a lid for a beverage container and having a plurality of integral, rupturable mix compartments for storing a plurality of beverage additives.

U.S. Pat. No. 5,310,564, issued in the name of Kimm, describes a beverage container with a plurality of rupturable tubular members for selectively imparting one (1) or more flavors into a beverage.

U.S. Pat. No. 6,609,612, issued in the name of Vlodek, describes a closure for a beverage receptacle with a plurality of selectively operable plungers that pierce a seal to dispense additives into the receptacle.

While these devices fulfill their respective, particular objectives, each of these references suffer from one or more disadvantages. Many such devices allow a user to customize a beverage by mixing one (1) or more flavors at a user-selected time. However, these devices generally introduce the flavor into a base liquid (typically water), and once the flavor is mixed within the water, the user is forced to consume the remainder of the liquid with that flavor. The only available variety is in adding additional flavors within the already mixed liquid. Accordingly, there exists a need for a beverage container that affords a user customizability and variety with regards to flavoring but without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a beverage container that enables a user to combine more than one (1) flavor with water in the context of a single serving while providing a means for switching back and forth between flavors. Thus, the object of the present invention is to solve the aforementioned disadvantages and provide for this need.

To achieve the above objectives, it is an object of the present invention to provide a means for selectively flavoring a beverage during consumption by providing a beverage container that enables a user to mix one (1) or more liquid additives into a base fluid such as water within the container. The apparatus comprises a hollow beverage container, an additive dispensing section located at a top of the beverage container, and a drinking cup portion affixed to a top of the additive dispensing section.

Another object of the present invention is to provide the additive dispensing section with a plurality of additive vials each containing a volume of an additive. The additive vials can each contain a different flavoring agent that can be selectively mixed with the base fluid.

Yet still another object of the present invention is to provide a particular constructed straw that provides fluid communication between the hollow beverage container and the drinking cup portion. The straw has a lower section extending downwardly into the hollow beverage container from the additive dispensing section and an upper section extending from the additive dispensing section upwardly into the drinking cup portion. As the base fluid flows upwardly through the lower straw section, it passes through the additive dispensing section and past each of the additive vials before emptying into the drinking cup portion.

Yet still another object of the present invention is to allow a user to selectively introduce one (1) or more of the additives at a time into the base fluid by depressing a digit-operated bulb section of a corresponding additive vial. The bulb is located on an exterior of the apparatus and causes an interior split body portion of the bulb to open within the additive dispensing section, thereby releasing a portion of the contained additive into the additive dispensing section where it is contacted by and mixed with a flow of base fluid.

Yet still another object of the present invention is to comprise the bulbs of a variety of colors to allow a user to discern and distinguish which bulb corresponds to which additive.

Yet still another object of the present invention is to enable a user to provide varying flavors from one (1) sip to another by releasing a small volume of one (1) additive into the flow of base fluid and mixing it into the drinking cup portion, consuming the flavored fluid, and releasing a small volume of a different additive prior to a subsequent drink.

Yet still another object of the present invention is to provide a check valve within the lower straw section that prevents flavored base fluid from re-entering the beverage container and contaminating the unflavored base fluid.

Yet still another object of the present invention is to provide a vent valve within the beverage container that allows air to backfill the beverage container after it is squeezed. This facilitates use by allowing a user to consistently squeeze the beverage container in order to force the base fluid upwardly through the lower straw section and into the additive dispensing section.

Yet still another object of the present invention is to comprise a top end of the upper straw section of a bifurcated nozzle which directs the flavored base fluid into the drinking cup portion. The nozzle provides a final mixing means to ensure that a dispensed additive is thoroughly mixed within the base fluid prior to consumption.

Yet still another object of the present invention is to provide a sealed packaging having a perforated pull tab to ensure that the cup portion and additive dispensing section of the apparatus remain sanitary prior to use and to further ensure that the apparatus is not tampered with.

Yet still another object of the present invention is to provide a method of utilizing the device that provides a unique means of procuring a beverage using the apparatus and having a desired base fluid and flavor additives, removing the seal, dispensing a desired additive or multiple additives, squeezing the container to base fluid into the additive dispensing section for mixing, continuing to squeeze the container until a desired volume of mixed beverage is received into the drinking cup, consuming the mixed beverage, repeating the additive dispensing, and enjoying a convenient means of creating and consuming a custom-mixed beverage.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

Figure 1:
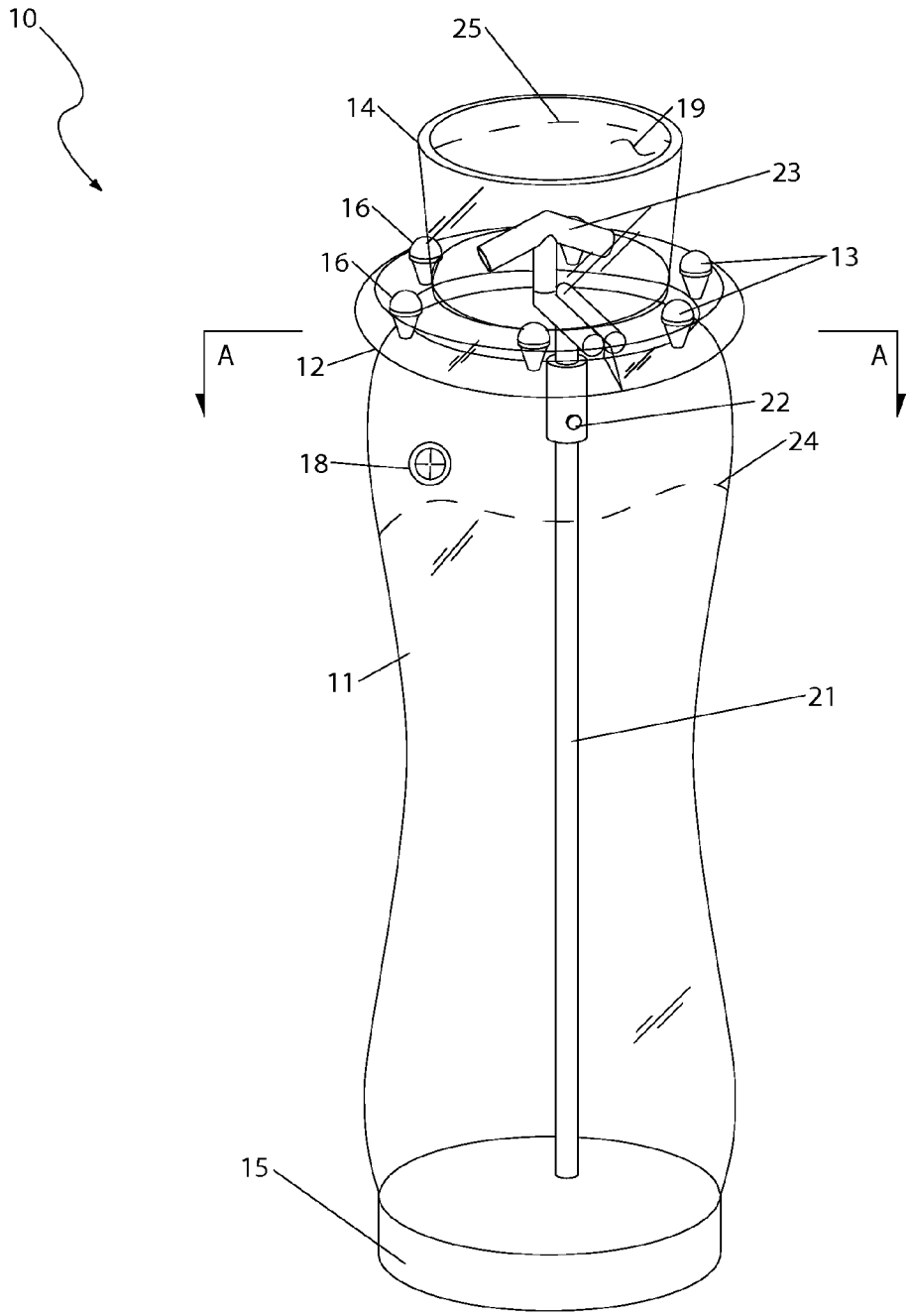
FIG. 1 is a perspective view of a selectable flavor dispenser for a beverage container 10, according to a preferred embodiment of the present invention.

| DESCRIPTIVE KEY | |
|---|---|
| 10 | selectable flavor dispenser for a beverage container |
| 11 | container |
| 12 | additive dispensing section |
| 13 | additive |
| 14 | drinking cup |
| 15 | container base |
| 16 | additive vial |
| 18 | vent valve |
| 21 | lower straw section |
| 22 | check valve |
| 23 | bifurcated nozzle |
| 24 | base fluid |
| 25 | mixed beverage |
| 26 | upper straw section |
| 30 | fluid flow |
| 36 | bulb |
| 38 | body |
| 50 | shrink wrap seal |
| 52 | pull tab |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a selectable flavor dispenser for a beverage container (herein described as the "apparatus") 10, which provides a point of use for mixing of a base fluid 24 such as water, and various liquid additives 13 to produce a mixed beverage 25 within a cup portion 14 of the apparatus 10, which enables a user to consume therefrom.

Referring now to FIG. 1, a perspective view of the apparatus 10, according to the preferred embodiment of the present invention, is disclosed. The apparatus 10 comprises a transparent or translucent plastic three-section assembly comprising a hollow beverage container 11, a torus-shaped additive dispensing section 12 affixed along a top edge of said container 11, and a drinking cup portion 14 affixed to an upper surface of said additive dispensing section 12. Said portions 11, 12, 14 of the apparatus 10 are arranged vertically along a common center axis being joined using common plastic joining processes such as, but not limited to: plastic welding, adhesives, or the like.

The container 11 comprises a hollow flexible hourglass-shaped or cylindrical vessel further comprising an integral semi-rigid container base 15 and a vent valve 18 which provides a means to backfill said container 11 with air as the base fluid 24 is displaced.

The additive dispensing section 12 comprises a torus-shaped chamber in which the mixed beverage 25 is prepared by internally mixing a liquid additive 13 from said additive dispensing section 12 and a volume of base fluid 24 from the container 11. The additive dispensing section 12 comprises a plurality of additive vials 16, a lower straw section 21, and an upper straw section 26. Said additive vials 16 provide a means to contain and dispense a volume of liquid additive 13 into said base fluid 24 to produce the mixed beverage 25. The additive vials 16 comprise a plurality of individual digit-operated devices permanently affixed and arranged in an equally-spaced manner along a top surface of the additive dispensing section 12 in a water-tight manner. Each additive 13 is envisioned to comprise a colored and flavored concentrated liquid which once mixed with the base fluid 24 provides an attractive and enjoyable mixed beverage 25 (see FIG. 3).

The apparatus 10 is envisioned to be introduced having at least one (preferably a plurality) of selectable additive vials 16 being pre-charged with liquid additives 13, and a predetermined volume of base fluid 24 within the container 11. Finally, the upper portions of the apparatus 10 are packaged using a tamper-proof shrink-wrap seal 50 (see FIG. 4).

Figure 2:
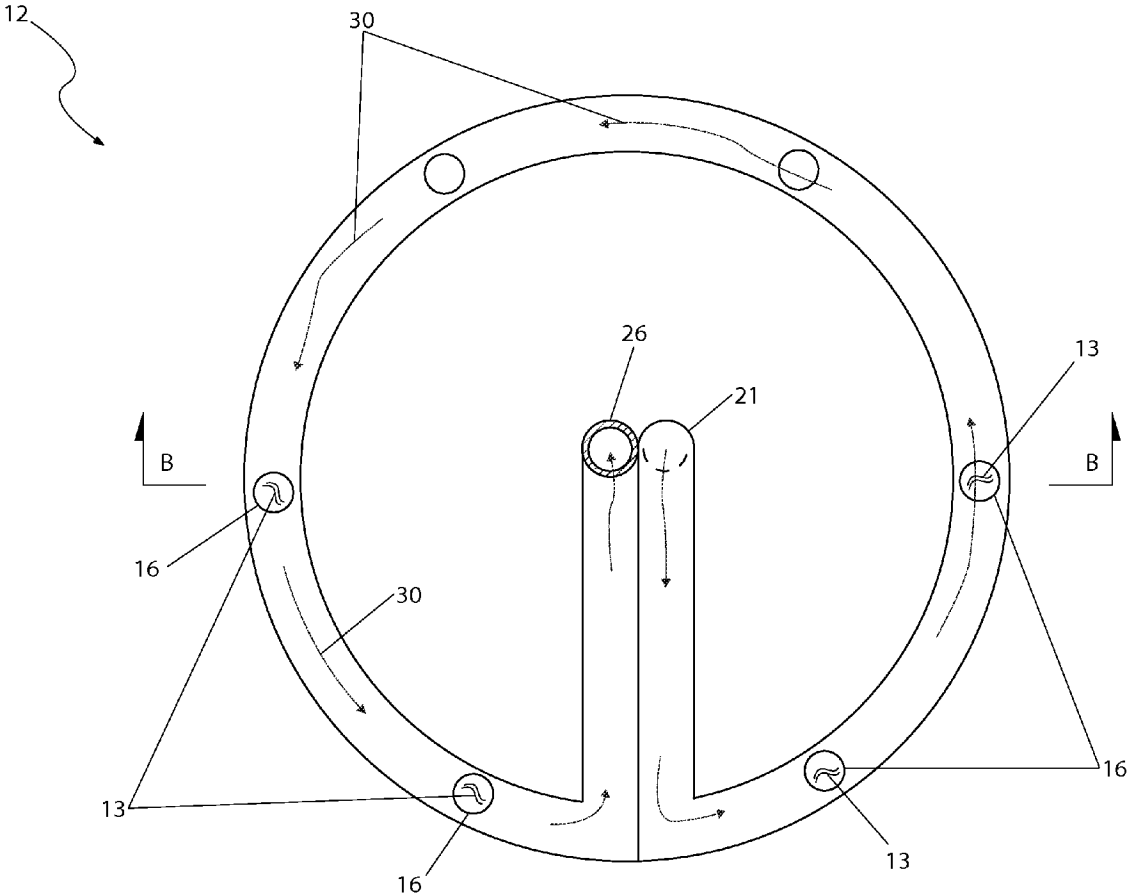
FIG. 2 is a horizontal section view through an additive dispensing portion 12 of the selectable flavor dispenser for a beverage container 10 taken along section line A-A (see FIG. 1), according to a preferred embodiment of the present invention.
Figure 3:
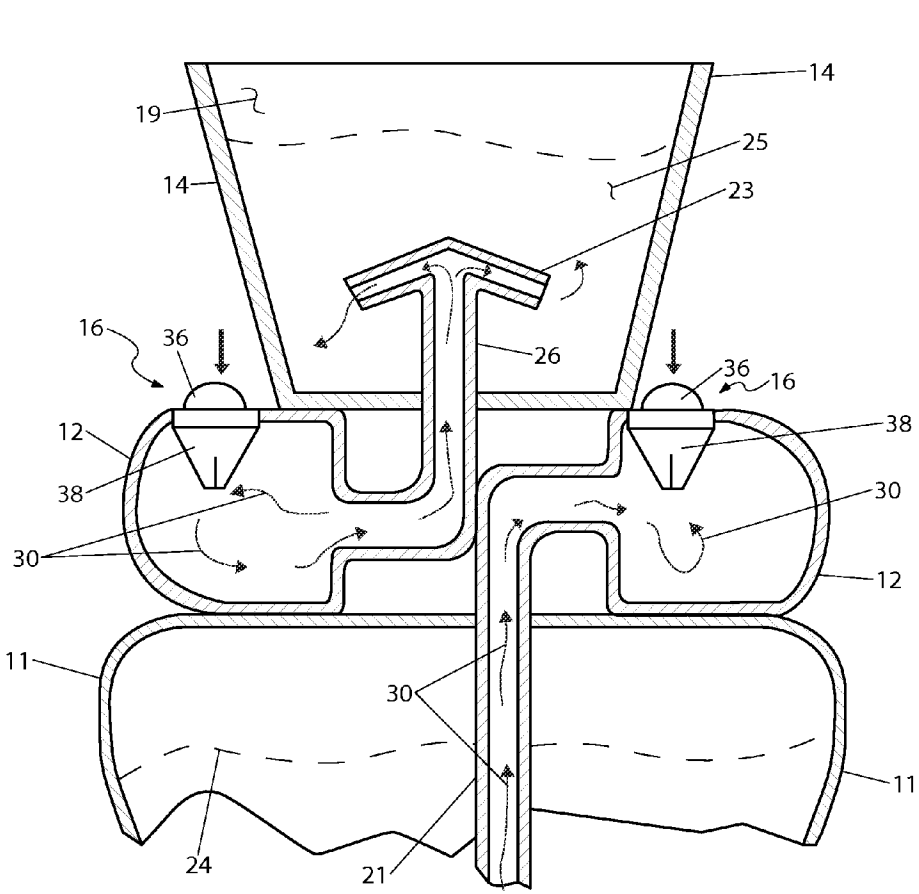
FIG. 3 is a vertical section view through the additive dispensing portion 12 of the selectable flavor dispenser for a beverage container 10 taken along section line B-B (see FIG. 2), according to a preferred embodiment of the present invention; and, FIG. 4 is a perspective view of a selectable flavor dispenser for a beverage container 10 depicting a packaged state, according to a preferred embodiment of the present invention.

Referring now to FIGS. 2 and 3, horizontal and vertical section views through the additive dispensing section 12 of the apparatus 10, according to a preferred embodiment of the present invention, are disclosed. Each of the additive vials 16 are operated by a respective digit-operated flexible button-shaped or hemispherical bulb 36 being disposed along an upper peripheral exterior portion of the additive dispensing section 12. Each bulb 36 comprises indicia thereon or adjacent thereto, thereby indicating the type of additive 13 stored within. Preferably, each bulb 36 is envisioned to be correspondingly color-coded according to a particular contained additive 13 to be mixed with the base fluid 24. As a user presses said bulb 36, a metered quantity of additive 13 is dispensed downwardly from an integral split body portion 38 of the additive vial 16 internal to the additive dispensing section 12. Said split body 38 comprises a molded rubber or plastic device which opens to release a quantity of additive 13 into the additive dispensing section 12 due to the pressure applied to the bulb 36. Said split body 38 then returns to a closed-state to retain a remaining volume of additive 13 within. It is understood that the additives 13 may comprise a variety of liquid products such as, but not limited to: flavoring, coloring, vitamins, nutritional additives, and the like.

An interior portion of said additive dispensing portion 12 comprises integral plastic molded or otherwise assembled fluid conveying portions including a downwardly extending lower straw section 21 and an upwardly extending upper straw section 26. The lower straw section 21 provides a plastic straw-like conduit which extends downwardly ending slightly above a bottom surface portion of the container base 15. In use, a volume of base fluid 24 is propelled upwardly into the additive dispensing portion 12 and subsequently into the drinking cup interior 19 of the top-mounted drinking cup portion 14 as the container 11 is manually squeezed, thereby pressurizing the contained base fluid 24. The lower straw section 21 further comprises an in-line check valve 22 which retains the upwardly propelled base fluid 24 within the additive dispensing section 12. As said base fluid 24 is received within said additive dispensing section 12, said base fluid 24 is propelled in a horizontal circular direction within said additive dispensing section 12 to provide a mixing fluid flow 30 to obtain mixing of the previously dispensed additive 13 and is in turn propelled upwardly into the upper straw section 26. Said upward flow is generated each time a user squeezes the container 11 until the base fluid 24 is exhausted. The aforementioned vent valve portion 18 of the container 11 allows incoming air to replace a displaced volume of the base fluid 24, thereby allowing said container 11 to restore its shape.

The upper straw section 26 comprises an integral "Y"-shaped bifurcated nozzle 23 at a top end portion, being positioned within the drinking cup portion 14. The bifurcated nozzle 23 is envisioned to provide a final mixing means to the mixed beverage 25. The drinking cup 14 is envisioned to comprise a flared or straight-sided vessel with an interior 19 suitable to provide a normal drinking means of the prepared beverage 25. It is understood that the mixed beverage 25 may be replenished repeatedly as desired using a single additive vial 16 or a combination of additive vials 16 to provide various beverages 25 as desired until the volume of base fluid 24 is exhausted.

The various elements of the apparatus 10 are envisioned to be made of food grade plastic materials, wherein the container 11, the additive dispensing section 12, and the drinking cup 14 comprise a clear or attractively tinted translucent plastic. The lower 21 and upper 26 straw sections are envisioned to comprise a section of semi-rigid plastic tubing, wherein a lower open end portion clears a bottom interior surface portion of the container base 15.

Figure 4:
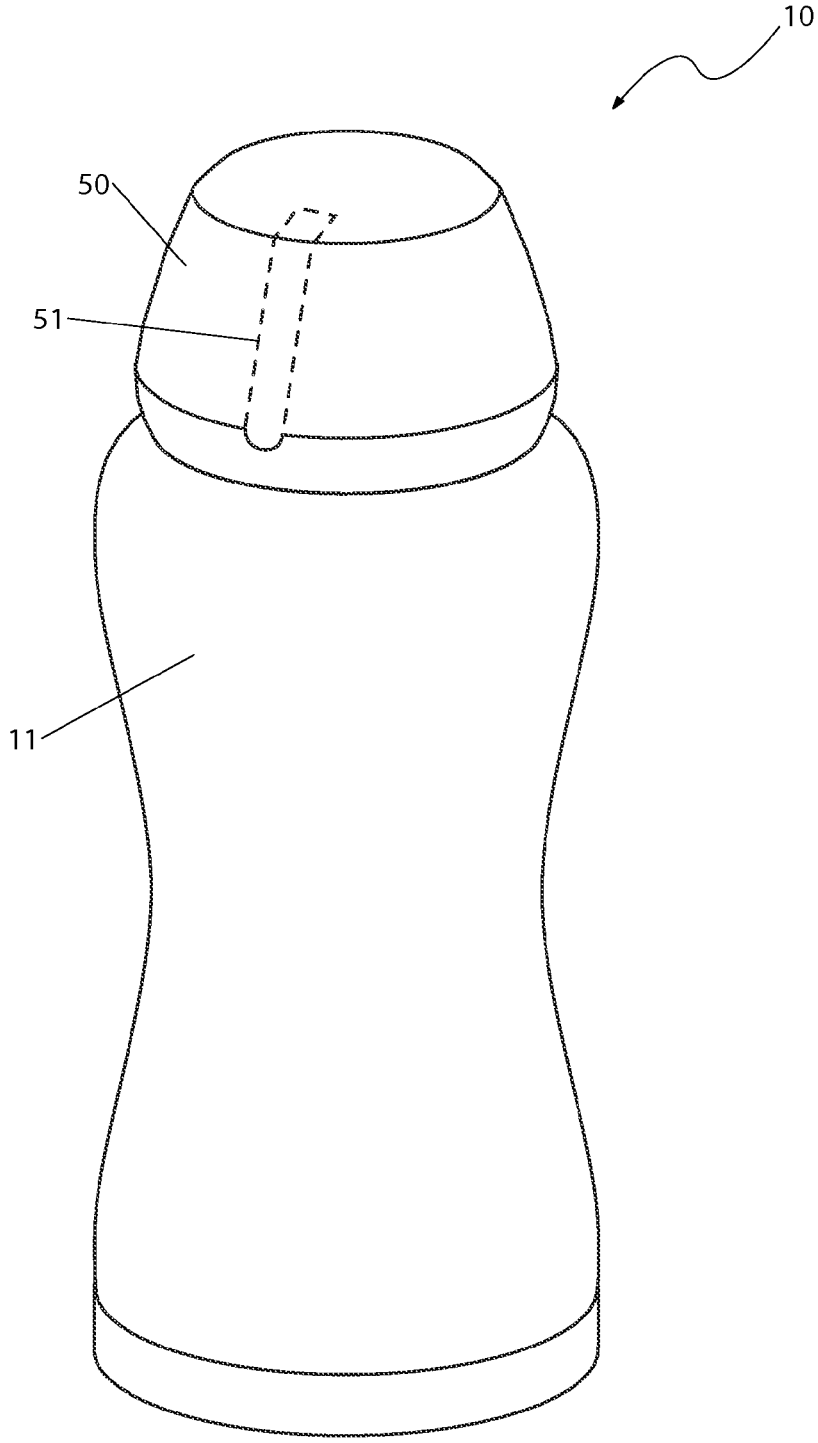

Referring now to FIG. 4, a perspective view of the apparatus 10 depicting a packaged state, according to a preferred embodiment of the present invention, is disclosed. The apparatus 10 is envisioned to be packaged in a tamper-proof manner using a common shrink-wrap seal 50 envisioned to have a perforated pull tab feature 52 and encompassing an upper portion of the apparatus 10 including the additive dispensing section 12 and the drinking cup portion 14 for sanitary and safety purposes.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIG. 1.

The method of utilizing the apparatus 10 may be achieved by performing the following steps: procuring a single unit or a multi-packaged portion of the apparatus 10; removing the tamper-proof shrink wrap seal 50 from the apparatus 10 using the pull tab feature 52; selecting a desired additive 13, or multiple additives 13, according to the color-code of the respective bulb 36; pressing the bulb 36 to dispense a volume of additive 13 from the respective additive vial 16 into the additive dispensing section 12; dispensing additional additive 13 as described above, until a desired number and amount of additives 13 is dispensed; squeezing the container 11 to propel a desired volume of base fluid 24 into the additive dispensing section 12 for mixing; continuing to squeeze the container 11 until a desired volume of mixed beverage 25 is received into the drinking cup 14; consuming said volume of the mixed beverage 25 within the drinking cup 14 by tilting the apparatus 10 in a normal manner; repeating the additive dispensing, base fluid 24 propulsion, and drinking of the mixed beverage 25 as desired, or until such time as the base fluid 24 within the container 11 is exhausted; and, enjoying a convenient means of creating and consuming a custom-mixed beverage 25 afforded the user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A beverage dispenser, comprising:

a flexible container having a top and a bottom;

a vent valve passing into said container for allowing air to enter;

a torus shaped dispensing section affixed to said top;

a cup affixed above said dispensing section;

a lower straw extending from adjacent said bottom into said dispensing section;

an upper straw extending from said dispensing section into said cup; and a first dispensing vial passing into said dispensing section, said first vial having a deformable external first bulb for retaining an additive and a split body for retaining the additive in said vial until said first bulb is deformed, said first vial forming a water-tight seal with said dispensing section;

wherein said first vial is accessible by a user such that said user can press said first bulb; and, wherein when said container is deformed a fluid in said container is propelled up said lower straw, through said dispensing section with a mixing action, up said upper straw, and into said cup.

2. The beverage dispenser of claim 1, wherein said body is hourglass shaped before deformation.

3. The beverage dispenser of claim 1, wherein said vent valve is located adjacent said top.

4. The beverage dispenser of claim 1, wherein said lower straw includes a check valve preventing fluid in said dispensing section from flowing into said container.

5. The beverage dispenser of claim 1, further including a first additive in said first vial, wherein said split body separates to dispense said first additive into said dispensing section when said first bulb is depressed and wherein said split body closes to seal remaining said first additive in said first bulb when said bulb is released.

6. The beverage dispenser of claim 5, wherein said first bulb is color-coded to designate said first additive.

7. The beverage dispenser of claim 1, wherein said cup has a body with an outwardly flared perimeter.

8. The beverage dispenser of claim 1, wherein said upper straw has a bifurcated upper end.

9. The beverage dispenser of claim 1, further including a first additive in said first vial and a primary fluid in said container, wherein said split body separates to dispense said first additive into said dispensing section when said first bulb is depressed, wherein said split body closes to seal said first additive in said first bulb when said bulb is released, and wherein deforming said container forces said primary fluid into said dispensing section for mixing said primary fluid with said first additive.

10. The beverage dispenser of claim 9, further including a second additive in a second vial having a second bulb and a second split body wherein said second additive is dispensed into said dispensing section when said second bulb is depressed.

11. The beverage dispenser of claim 10, wherein said first bulb is color-coded to visually designate said first additive and said second bulb is color coded to designate said second additive.

* * * * *